United States Patent [19]

Adachi et al.

[11] 4,085,058

[45] Apr. 18, 1978

[54] ELECTROPHOTOGRAPHIC LIQUID DEVELOPER CONTAINING A GRAFT COPOLYMER OF A CYCLIZED RUBBER

[75] Inventors: Syozo Adachi; Masato Tamori, both of Tokyo, Japan

[73] Assignee: Iwatsu Electric Co., Ltd., Tokyo, Japan

[21] Appl. No.: 688,263

[22] Filed: May 20, 1976

Related U.S. Application Data

[63] Continuation-in-part of Ser. No. 455,875, Mar. 28, 1974, abandoned.

[30] Foreign Application Priority Data

Apr. 4, 1973 Japan ..... 48-37869

[51] Int. Cl.[2] ..... G03G 9/12

[52] U.S. Cl. ..... 252/62.1 L; 101/453; 96/1 LY; 260/879; 260/33.6 A; 427/15; 427/17

[58] Field of Search ..... 252/62.1 L; 260/879, 260/33.6 A; 101/453; 96/1 LY; 427/15, 17

[56] References Cited

U.S. PATENT DOCUMENTS

| | | | |
|---|---|---|---|
| 3,432,577 | 3/1969 | Serniuk | 260/879 |
| 3,510,338 | 7/1969 | Varron | 252/62.1 |
| 3,585,140 | 6/1971 | Machida et al. | 252/62.1 |
| 3,629,117 | 11/1971 | Okuno | 252/62.1 |
| 3,639,243 | 2/1972 | Okuno et al. | 252/62.1 |
| 3,639,244 | 2/1972 | Machida et al. | 252/62.1 |
| 3,640,863 | 2/1972 | Okuno et al. | 252/62.1 |
| 3,657,130 | 4/1972 | Machida et al. | 252/62.1 |
| 3,674,693 | 7/1972 | Averbach | 252/62.1 |
| 3,729,418 | 4/1973 | Machida et al. | 252/62.1 |

FOREIGN PATENT DOCUMENTS

| | | | |
|---|---|---|---|
| 788,651 | 1/1958 | United Kingdom | 260/881 |
| 797,346 | 7/1958 | United Kingdom | 260/881 |
| 893,429 | 4/1962 | United Kingdom | 260/881 |

*Primary Examiner*—Ralph S. Kendall
*Assistant Examiner*—John D. Smith

[57] ABSTRACT

A liquid developer for use in preparing a printing plate for an offset duplicator is provided. The liquid developer comprises a dispersion of image-forming materials comprising finely divided colorant particles and an acrylic or methacrylic acid estergrafted cyclized rubber in a liquid carrier of a high electrical resistivity and a low dielectric constant.

3 Claims, No Drawings

ELECTROPHOTOGRAPHIC LIQUID DEVELOPER CONTAINING A GRAFT COPOLYMER OF A CYCLIZED RUBBER

This is a continuation-in-part application of Ser. No. 455,875, filed Mar. 28, 1974, now abandoned.

This invention relates to a liquid developer used for wet processing in electrophotography, comprising a dispersion of image-forming materials in a hydrocarbon liquid carrier of a high electrical resistance and a low dielectric constant. The liquid developer of the invention is useful particularly for the preparation of a copy having a visible image formed on a sensitized paper, which copy is satisfactorily used as an offset printing plate in duplicators to reproduce hundreds or thousands of copies.

Heretofore many proposals have been made to improve the dispersibility of image-forming solid toner particles in a liquid carrier and the adhesion thereof to a sensitive paper. For example, a liquid developer prepared by milling toner particles and an acrylic resin such as a methacrylic acid-lauryl methacrylate copolymer thereby coating the toner particles with the resin was proposed. Although such an acrylic resin exhibits good dispersibility, it is not satisfactory in dispersion stability; that is, the acrylic resin coated on the toner particles gradually dissolves into the liquid carrier with a lapse of time, leading to a reduction of polarity of the toner particles and an adhesion of the toner particles to a sensitive paper. Even if a greater amount of an acrylic resin is employed, it is in itself poor in adhesion to a sensitive paper and the resulting copy paper is incapable of being used as a printing plate in duplicators to reproduce hundreds or thousands of copies.

Recently, it has been proposed to employ a cyclized rubber as disclosed in U.S. Pat. No. 3,640,863. A cyclized rubber and a cyclized rubber-containing resin are good in adhesion of the developed image to a sensitive paper. However, these materials possess a few detrimental limitations wherein both the degree of cyclization and the molecular weight distribution greatly fluctuate depending upon the conditions under which the cyclized rubber is produced. Further, a liquid developer having a cyclized rubber incorporated therein is poor in dispersion stability, i.e., the toner particles coated therewith are apt to agglomerate and precipitate in the liquid developer. Therefore, these materials are not suitable for the preparation of a printing plate used in the offset duplicator.

Therefore, it is an object of the present invention to provide a liquid developer which is stable for storage, i.e., the toner particles do not agglomerate and precipitate after the elapse of a long period of time, and which produces images having good adhesion to sensitive paper and good receptivity to printing ink and, therefore, said liquid developer is suitable for the preparation of a printing plate used in the offset duplicator to reproduce numerous copies.

Other objects and advantages will become apparent from the following description.

According to the present invention, there is provided an electrophotographic liquid developer for use in preparing a printing plate for an offset duplicator which comprises a dispersion of image-forming materials comprising finely divided colorant particles selected from the group consisting of dyes and pigments in a liquid carrier having an electrical resistivity of not less than $10^8$ ohm-cm and a dielectric constant of not more than 3.0, said liquid carrier being at least one hydrocarbon selected from the group consisting of n-paraffinic hydrocarbons, iso-paraffinic hydrocarbons and their mixtures, characterized in that said image-forming material further comprises a graft copolymer of a cyclized rubber onto which an ester of at least one acid selected from either an acrylic acid or a methacrylic acid is grafted, said cyclized rubber having the recurring unit expressed by the structural formula

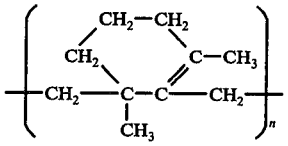

and the amount of said graft copolymer being such that the ratio by weight of said graft copolymer to the colorant particles is within the range of 5/3 to 3/5.

A cyclized rubber to be used for the preparation of the acrylate or methacrylate-grafted cyclized rubber may be prepared by isomerization of natural rubber. For example, a solution of raw rubber in a petroleum distrillate is treated with a cyclizing agent such as titanium tetrachloride, tin tetrachloride and concentrated sulfuric acid; or raw rubber is kneaded together with a cyclizing agent such as tin dichloride and sulfonic acid by heated rollers. A cyclized rubber prepared by such isomerization from natural rubber is considered to possess the following structural formula as proposed by D'Ianni, although it has not been definitely elucidated.

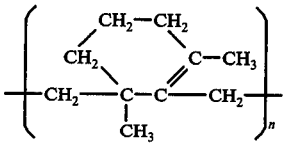

Beside the cyclized rubber prepared by the isomerization of natural rubber, a cyclized rubber prepared by cyclization of synthetic polyisoprene may also be employed.

Usually, cyclized rubber of a relatively high degree of cyclization has a relatively low molecular weight and vice versa. A cyclized rubber of a large degree of cyclization and a low molecular weight results in the image-forming materials having a somewhat reduced dispersibility in the liquid carrier. In contrast, a cyclized rubber of a small degree of cyclization and a high molecular weight results in the liquid developer having an inevitably increased viscosity, in spite of an increase of the dispersibility. This increased viscosity causes a reduction of the mobility of the toner particles in the liquid developer. A preferable cyclized rubber includes those having an average molecular weight of greater than approximately 9,000 and, an average degree of cyclization of 20% to 80%, particularly 40% to 60%.

The copolymer of a cyclized rubber and an ester of acrylic acid or methacrylic acid is considered to possess a structure such that the acrylate or methacrylate is grafted onto at least a part of the unsaturation existing in the cyclized portion of the polyisoprene structure. In other words, the copolymer possesses a structure comprising the stem component of a cyclized rubber having good adhesion and fixing capability of the developed image to a sensitive paper, and the graft component of acrylate or methacrylate having improved affinity with petroleum hydrocarbon carriers.

Esters of acrylic acid and methacrylic acid to be copolymerized with a cyclized rubber are preferably, alkyl or substituted alkyl esters of acrylic acid, the alkyl or substituted alkyl group having at least four carbon atoms, and alkyl or substituted alkyl esters of methacrylic acid, the alkyl or substituted alkyl group having at least three carbon atoms. The alkyl esters include, for example, butyl acrylate, butyl methacrylate, 2-ethylhexyl acrylate, 2-ethylhexyl methacrylate, lauryl methacrylate and stearyl methacrylate. By the term "substituted alkyl esters" used herein is meant those having an alkyl group possessing a functional substituent, for example, carboxyl, hydroxyl, amino or epoxy. Such substituted alkyl esters include, for example, diethylaminoethyl acrylate and glycidyl methacrylate. These acrylates and methacrylates may be used alone or in combination. In combination with the acrylates and methacrylates, a minor amount of other copolymerizable monomers may be used unless the monomers exhibit a bad effect on the liquid developer.

The amount of the acrylate or methacrylate to be polymerized in the presence of a cyclized rubber may be suitably varied within the range from 5% to 95% by weight based on the total weight of the acrylate or methacrylate and the cyclized rubber. When the amount of the acrylate or methacrylate is less than approximately 5% by weight, the copolymer has a poor dispersibility. In contrast, when the amount of the acrylate or methacrylate exceeds approximately 95%, the liquid developer is poor in the fixing capability of the developed image to a sensitive paper. A more preferable amount of the acrylate or methacrylate is within the range of from 20% to 60% by weight.

The amount of the cyclized rubber-acrylate or methacrylate copolymer to be incorporated into the liquid developer is generally such that a ratio by weight of the copolymer to a toner, i.e., colorant particles, is within the range of 5/3 to 3/5, and that when the amount of the copolymer is less than the lower limit, the toner is not well dispersed and the developed image is poor in adhesion to the sensitive paper. In contrast, when the amount of the copolymer exceeds the upper limit, the developed image is pale.

The cyclized rubber-acrylate or methacrylate copolymer preferably has a viscosity of V to $Z_6$ as measured in toluene at a temperature of 25° C and a concentration of 10% by weight by using a Gardner-Holdt bubble meter.

The copolymerization of a cyclized rubber and the acrylate or methacrylate may preferably be performed by a solution or emulsion polymerization procedure in the presence of a catalytic amount of an initiator.

Suitable liquid carriers which are used in the preparation of the liquid developer of the present invention comprises liquids possessing an electrical resistance of not less than $10^8$ ohm-cm and a dielectric constant of not more than 3.0. This precludes the possibility of discharging the latent electrostatic image and/or dissipation of the energy in the image field in aligning and moving highly polar substances. Liquids which have been found useful include, for example, n-paraffinic hydrocarbons such as n-pentane and n-hexane; isoparaffinic hydrocarbons such as Isopar H and Isopar G (both trade names, made by Esso-Standard Oil); and petroleum distillates such as kerosene, mixtures thereof and the like. In combination with these liquid carriers, minor amounts of other liquid mediums may be used.

The colorants employed as image forming materials are not critical and can be chosen from a wide variety of known inorganic and organic pigments and dyestuffs. Such as for example, carbon black (C.I. 77265 and 77266), Phthalocyamine Blue (C.I. 74160), Chrome Yellow (C.I. 77600), Aniline Black (C.I. 50440), red iron oxide (C.I. 77491), Oil Black (C.I. 50415), Oil Red (C.I. 26110) and Malachite Green (C.I. 42000). Coated colorant particles such as resin-coated pigments and graft-copolymerized carbon black, and colored resins prepared by reacting resins with a colorant also may be used. These colorants may be used either alone or in combination with each other, and preferably have an average particle size of not more than 10 $\mu$.

The concentration of the image forming material, i.e., the total amount of the cyclized rubber-acrylate or methacrylate copolymer and the colorant particles in the liquid developer, may be varied depending upon the particular colorant particle, the amount of the copolymer and the intended liquid developer. A preferable concentration of the image forming material is 0.01% to 0.5% by weight for use in producing copies by a procedure other than printing and 0.5% to 2.0% by weight for use in preparing an offset printing plate. A higher concentration of the image forming material such as 10% to 30% by weight may be employed, for example, when the liquid developer is used as a replenishing liquid developer.

The manner whereby the liquid developer of the present invention is prepared is not critical. Preferably, the colorant particles, the cyclized rubber-acrylate or methacrylate copolymer and a part of the liquid carriers as exemplified above and/or other liquid mediums such as aromatic hydrocarbons, for example, toluene, xylene and Solvesso 150 (aromatic hydrocarbon solvent predominantly comprised of $C_9$–$C_{11}$ aromatics, supplied by Esso-Standard Oil) are mixed by a suitable mixing by a suitable mixing means such as by a ball mill or roll mill, and then diluted with a large amount of the remaining liquid carrier. It is also possible to incorporate the cyclized rubber-acrylate or methacrylate copolymer in a conventional electrophotographic liquid developer preparation.

The liquid developer of the present invention possesses not only high fixing and adhering capabilities of the developed image to a sensitive paper, but also improved dispersibility and dispersion stability as mentioned hereinbefore. The dispersibility and dispersion stability of the cyclized rubber acrylate or methacrylate copolymer are shown in Table I, below, in comparison with those of the cyclized rubber, the polyacrylate and polymethacrylate and a mixture of cyclized rubber and polyacrylate or polymethacrylate.

Table I

| Specimen | *1 Appearance | *2 Viscosity | Dispersibility or solubility *3 in toluene | in Isopar H |
|---|---|---|---|---|
| A Cyclized *4 rubber | Light brown | X-Z | Soluble, light yellowish brown | Coheres, precipitates and is deposited on wall of vessel |

Table I-continued

| Specimen | *1 Appearance | *2 Viscosity | Dispersibility or solubility *3 in toluene | in Isopar H |
|---|---|---|---|---|
| B Poly-2- *5 ethylhexyl acrylate | White | Lower than A | Soluble, colorless transparent | Soluble, colorless transparent |
| C Polylauryl *6 methacrylate | White | D-E | " | " |
| 1:1 mixture of A+B | Light yellow | Q-R | Separated into 2 phases after about 1 hr; the upper transparent and the lower light brown | Cyclized rubber coheres and is deposited on wall of vessel after scores of min. |
| 1:1 mixture of A+C | Light yellow | S-T | " | " |
| 1:1 copolymer of A/B | Light yellow | Y-$Z_1$ | Soluble, light yellow: No change was observed after 1 month. | Light yellow, transluscent colloidal dispersion: No change was observed after 1 month. |
| 1:1 copolymer of A/C | Light yellow | $Z_1$-$Z_2$ | " | " |

(note)
*1 10% solution in toluene
*2 Measured in toluene at 25° C and 10% concentration by using Gardner-Holdt bubble viscometer
*3 Observed at 1% concentration
*4 Thermolite P (trade name, supplied by Seiko Chemical Co.)
*5 ACRYESTER EH (trade name, supplied by Mitsubishi Rayon Co.)
ACRYESTER L (trade name, supplied by Mitsubishi Rayon Co.)

The invention is further illustrated by reference to the following examples in which parts and percentages are by weight unless otherwise specified.

Preparation of copolymers

Reference Example 1

A mixture of 5 parts of a cyclized rubber ("Thermolite P", trade name, supplied by Seiko Chemical Co.), 5 parts of 2-ethylexyl acrylate, 0.1 part of benzoyl peroxide and 40 parts of toluene were gradually heated to a temperature of 200° C and maintained at that temperature for 6 hours, while being stirred, in 6 atomospheres of nitrogen to effect the polymerization. The polymer product was light yellow and viscoelastic, with a viscosity of Y to $Z_1$ as measured in toluene at a concentration of 10% by using Gardner-Holdt bubble viscometer.

Reference Example 2

Under conditions similar to those of Example 1, 5 parts of a cyclized rubber ("Pliolite NR 50", trade name, a cyclized product of synthetic polyisoprene, supplied by Goodyear Co.), and 5 parts of lauryl methacrylate were copolymerized in 50 parts of toluene in the presence of 0.1 part of azobisisobutyronitrile. The polymer product (specimen No. 4) was yellow and more viscoelastic than that of Example 1. The viscosity was $Z_1$ to $Z_2$ as measured in a manner similar to that of Example 1.

For comparison purposes, the above procedure was repeated wherein the ratio of the cyclized rubber and lauryl methacrylate was varied, as shown in Table II, with all other conditions remaining substantially the same.

Physical properties of the polymer products are described in Table II.

Table II

| Specimen No. | Composition (parts) Cyclized rubber | Lauryl methacrylate | Appearance *1 | Viscosity *2 | Dispersibility *3 |
|---|---|---|---|---|---|
| 1 | 10 | 0 | Light brown | X - Z | After several minutes, cohered and deposited onto the wall of vessel |
| 2 | 9 | 1 | Light yellowish brown | $Z_3$-$Z_4$ | Light yellow colloidal dispersion. |
| 3 | 6 | 4 | | $Z_2$-$Z_3$ | No change was observed after one month. |
| 4 | 5 | 5 | | $Z_1$-$Z_2$ | |
| 5 | 4 | 6 | | X - Z | White colloidal dispersion. No change was observed after one month. |
| 6 | 1 | 9 | Light yellow | V - X | |
| 7 | 0 | 10 *4 | White, transparent | D - E | Transparent, colorless dispersion |

(Note)
*1 Appearance was observed in toluene at a concentration of 10%.
*2 Viscosity was determined in toluene at 25° C and a concentration of 10% by Gardner-Holdt bubble viscometer.
*3 Dispersibility was observed in Isopar H at a concentration of 1%.
*4 Homopolymer.

As can be seen in Table II, the viscosity of the polymer product increases with an increase in the ratio of the cyclized rubber to lauryl methacrylate. All specimens were superior in dispersibility to the cyclized rubber. It has been found that the preferable range of the ratio of the cyclized rubber to the methacrylate was approximately 9.5/0.5 to approximately 1/9.

Reference Example 3

Under conditions similar to those of Example 1, 8 parts of cyclized rubber ("Thermolite N", trade name, supplied by Seiko Chemical Co.) and 2 parts of stearyl methacrylate were copolymerized in 30 parts of a 1:1 mixture of toluene and xylene in the presence of 0.1 part of benzoyl peroxide, with all other conditions remaining substantially the same. The polymer product was light brown and viscous, with a viscosity of $Z_3$ to $Z_4$ as measured in a 1:1 mixture of toluene and xylene at a concentration of 10%.

Reference Example 4

Under conditions similar to those of Example 1, 8 parts of a cyclized rubber ("Thermolite S:", trade name, supplied by Seiko Chemical Co.) and 2 parts of lauryl methacrylate were copolymerized in 50 parts of Solvesso 150 in the presence of 0.1 part of benzoyl peroxide and 0.3 part of acrylamide. The polymer product was light brown and viscoelastic with a viscosity of $Z_3$ as measured in toluene at a concentration of 10%.

Preparation and Evaluation of liquid developer

The following examples are illustrative of liquid developers having incorporated therein, copolymers prepared by the procedures described in Reference Examples 1 through 4.

Performances of the liquid developers tested, i.e., (1) dispersion stability of the liquid developer, (2) density of the developed image, (3) adhesion of the developed image to sensitive paper and (4) receptivity of the developed image to printing ink were determined by the following procedures.

(1) Dispersion stability of the liquid developer. A liquid developer of a 50% concentration in terms of light transmissions is prepared. After storage, light transmission of the top part of the liquid developer is determined. The numerical data indicate the light transmission determined after storage. If a liquid developer did not change at all during storage, the light transmission is 50%, i.e., the liquid developer is completely stable. The clearer the top part of the developer, i.e., the greater the light transmittance, and after storage, the poorer the dispersion stability.

(2) Density of the developed image. Using the liquid developer specimen having a concentration of 50% in terms of light transmission a positive image of $1\times1$ cm$^2$ in solid area is formed on Elefax Master Paper QPM (trade name, Iwatsu Electric Co.) by a copying machine Elefax QP-1 (trade name, Iwatsu Electric Co.). The reflectance density of the image is measured by using a densitometer (supplied by Tokyo Koden Co.).

(3) Adhesion of the developed image to sensitive paper. Following the procedure set forth in the preceding item (2), positive images having a reflectance density of 1.2 are formed on Elefax Master Papers QPM. After 5 minutes or 30 minutes have lapsed from the development, a peel-off test using a pressure sensitive tape is carried out. Then, the reflectance density of the images remaining on the copy is determined. The greater the density, the greater the adhesion of the image to the sensitive paper.

(4) Receptivity of the developed image to printing ink. Using a printing plate having an image of a 1.3 density prepared from each liquid developer specimen, offset printing is carried out by using an offset printing duplicator AB Dick 324 and a printing ink "AB Dick 3-1010" (both trade names, supplied by AB Dick Co., U.S.A.). The tenth, 500th, and 1000th copies from the begining are extracted as sample specimens and tested for their densities. That is, the receptivity of the image on a printing plate to a printing ink is expressed in terms of the density of the image reproduced on the offset printed copies.

The densities used in the above-mentioned items (2), (3) and (4) are defined by the formula $$\text{Density} = \log 10\,(I_0/I)$$

wherein $I_0$ is an intensity of the light incident on the image and I is an intensity of the light passed through the image or the light reflected from the image.

EXAMPLE 1

| | |
|---|---|
| Acetylene black | 4 parts |
| Induline base N (C.I. 50400) supplied by BASF | 1 part |
| Rubbery material (40% solution in toluene) | 5 parts |
| Solvesso 150 | 10 parts |

The above mixture was kneaded by a roll mill of three rollers for approximately 1 hour. Then, the mixture was diluted with a liquid carrier to a concentration such that the non-volatile matter content was approximately 40%, and kneaded by a ball mill for approximately 10 hours. Approximately 20 g of the toner paste so obtained was dispersed in 2 *l* of a liquid carrier to produce a liquid developer.

The rubbery materials used are as follows. Specimen I Natural rubber latex produced in Malaya; Specimen II A graft copolymer prepared by treating natural rubber latex, similar to that used for the preparation of Specimen I, with 2-ethylhexyl acrylate by a procedure set forth in Reference Example 1; Specimen III Cyclized rubber "Thermolite P" (supplied by Seiko Chemical Co., Japan); and Specimen IV A graft copolymer of cyclized rubber (Thermolite P) with 2-ethylhexyl acrylate, obtained in Reference Example 1.

The liquid carriers used are as follows. Isopar H (an isoparaffinic hydrocarbon, supplied by Esso-Standard Oil Co.), dielectric constant (25° C, $1KH_2$), 2.01; resistivity (AC, 25° C, $1KH_2$), $0.5\times10^{14}$ ohm-cm; Isopar G (an isoparaffinic hydrocarbon, supplied by Esso-Standard Oil Co.), dielectric constant (25° C, $1KH_2$), 2.00; resistivity (AC, 25° C, $1KH_2$), $1.43\times10^{13}$; N-octane, dielectric constant (25° C, $1KH_2$), 2.14; resistivity (AC, 25° C, $1KH_2$), $2.0\times10^{14}$; and kerosene, dielectric constant (20° C, $1KH_2$), 1.96; resistivity (AC, 25° C, $1KH_2$), $1.0\times10^{12}$.

Test results of each liquid developer are shown in Table III, below. In Table I, "B" indicates data obtained by measuring immediately after the preparation of each liquid developer and "A" indicates data obtained by measuring after each liquid developer was maintained at 20° C over a period of one month.

Table III

| Specimen No. | Additive resin | Liquid carrier | Dispersion stability (%) A | Image density B | Image density A | Adhesion 5 min after development B | Adhesion 5 min after development A | Adhesion 30 min after development B | Adhesion 30 min after development A | Receptivity 10th copy B | Receptivity 10th copy A | Receptivity 500th copy B | Receptivity 500th copy A | Receptivity 1000th copy B | Receptivity 1000th copy A |
|---|---|---|---|---|---|---|---|---|---|---|---|---|---|---|---|
| Comparative Ex. | | | | | | | | | | | | | | | |
| I-1 | | Isopar H | 80 | 1.2 | 0.76 | 1.0 | 0.54 | 1.15 | 0.65 | 1.2 | 0.68 | 1.0 | 0.52 | — | 0.36 |
| I-2 | Natural | Isopar G | 76 | 1.2 | 0.8 | 0.97 | 0.46 | 1.12 | 0.61 | 1.17 | 0.65 | 0.96 | 0.48 | 0.75 | 0.30 |
| I-3 | rubber | N-octane | 70 | 1.16 | 0.72 | 0.84 | 0.36 | 0.98 | 0.43 | 1.03 | 0.52 | 0.76 | 0.38 | 0.61 | 0.20 |
| I-4 | | Kerosene | 73 | 1.2 | 0.76 | 0.92 | 0.41 | 1.07 | 0.52 | 1.12 | 0.56 | 0.87 | 0.40 | 0.66 | 0.25 |
| II-1 | Natural | Isopar H | 65 | 1.3 | 0.87 | 0.9 | 0.68 | 1.13 | 0.86 | 1.0 | 0.96 | 0.8 | 0.67 | — | 0.52 |
| II-2 | rubber | Isopar G | 60 | 1.3 | 0.92 | 0.82 | 0.60 | 1.10 | 0.82 | 1.15 | 0.88 | 0.78 | 0.63 | 0.62 | 0.42 |
| II-3 | copolymer | N-octane | 54 | 1.20 | 0.81 | 0.71 | 0.47 | 0.90 | 0.56 | 0.95 | 0.62 | 0.58 | 0.47 | 0.43 | 0.26 |
| II-4 | | Kerosene | 58 | 1.3 | 0.86 | 0.78 | 0.52 | 0.94 | 0.60 | 0.98 | 0.74 | 0.62 | 0.56 | 0.50 | 0.30 |

Table III-continued

| Specimen No. | Additive resin | Liquid carrier | Dispersion stability (%) A | Image density B | Image density A | Adhesion 5 min after development B | Adhesion 5 min after development A | Adhesion 30 min after development B | Adhesion 30 min after development A | Receptivity 10th copy B | Receptivity 10th copy A | Receptivity 500th copy B | Receptivity 500th copy A | Receptivity 1000th copy B | Receptivity 1000th copy A |
|---|---|---|---|---|---|---|---|---|---|---|---|---|---|---|---|
| III-1 | Cyclized rubber | Isopar H | 73 | 1.2 | 1.1 | 1.0 | 0.94 | 1.17 | 0.93 | 1.3 | 1.20 | 1.3 | 1.13 | — | 0.96 |
| III-2 | | Isopar G | 67 | 1.2 | 1.10 | 0.98 | 0.87 | 1.16 | 0.98 | 1.2 | 1.14 | 1.19 | 1.10 | 1.15 | 0.98 |
| III-3 | | N-octane | 58 | 1.17 | 0.92 | 0.87 | 0.75 | 0.97 | 0.86 | 1.12 | 1.06 | 1.03 | 1.01 | 1.00 | 0.93 |
| III-4 | | Kerosene | 62 | 1.2 | 0.98 | 0.93 | 0.82 | 1.10 | 0.94 | 1.15 | 1.10 | 1.12 | 1.03 | 1.06 | 0.96 |
| Invention IV-1 | Cyclized rubber copolymer | Isopar H | 52 | 1.3 | 1.2 | 1.1 | 1.03 | 1.2 | 1.19 | 1.5 | 1.5 | 1.5 | 1.42 | — | 1.38 |
| IV-2 | | Isopar g | 51 | 1.3 | 1.23 | 1.06 | 1.01 | 1.20 | 1.17 | 1.46 | 1.38 | 1.45 | 1.36 | 1.40 | 1.30 |
| IV-3 | | N-octane | 52 | 1.28 | 1.20 | 1.02 | 0.97 | 1.14 | 1.10 | 1.37 | 1.28 | 1.35 | 1.25 | 1.32 | 1.23 |
| IV-4 | | Kerosene | 52 | 1.3 | 1.20 | 1.04 | 1.01 | 1.18 | 1.12 | 1.43 | 1.32 | 1.40 | 1.30 | 1.38 | 1.27 |

As is apparent from Table III, both the adhesion of the developed images and the receptivity of the developed images to printing ink are on approximately the same level between specimens IV-1 through IV-4. Further, it has been found that n-paraffinic and iso-paraffinic hydrocarbons give the desired results provided that the hydrocarbons possess an electrical resistivity of not less than approximately $10^8$ ohm-cm and a dielectric constant of not more than approximately 3.0. The liquid developer of the invention (specimens IV-1 through IV-4) prepared using the graft-copolymerized cyclized rubber is superior to that (specimens III-1 through III-4) prepared by using a cyclized rubber in both the adhesion of developed images and the receptivity of the developed images to printing ink.

Liquid developers (specimens II-1 through II-4) prepared using an acrylic or methacrylic acid estergraft-copolymerized natural rubber are superior to those (specimens I-1 through I-4) prepared by using a natural rubber in dispersion stability in the liquid carrier, but are rather poor in both the adhesion of the developed images and the receptivity of the developed images to printing ink which adhesion and receptivity are determined on liquid developers before storage. In contrast, the liquid developers of the invention (specimens IV-1 through IV-4) are superior to those (specimens III-1 through III-4) prepared by using a cyclized rubber in both the adhesion of the developed images and the receptivity of the developed images to printing ink no matter whether adhesion and receptivity are determined on liquid developers before or after storage.

EXAMPLE 2

Following the procedure set forth in Example 1 a liquid developer was prepared wherein cyclized rubber Thermolite P and liquid carrier Isopar H were used.

The liquid developer was maintained of a temperature of 60° C over a period of 1 month in a closed vessel for the purposes of accelerating the fest for defermining the dispers, on stability, after which test the performances of the liquid developer were similar to those prior to storage wherein neither deposition nor cohesion was observed. A copy for use as an offset printing plate was prepared and offset-printed copies were reproduced, in a manner similar to that in Example 1. All images of the copies were clear similar to that of the copies in Example 1.

| | |
|---|---|
| Graft-copolymerized carbon black (SLC-512, supplied by Nihon Gas Kagaku) | 3 parts |
| Phenoplast Black BB (C.I. 50,415) | 2 parts |

-continued

| | |
|---|---|
| Rosin | 1 part |
| Graft copolymer prepared in Reference Example 2 (40% solution in toluene) | 4 parts |
| Solvesso 150 | 20 parts |

The above mixture was keaded by a roll mill of three rollers for approximately 1 hour. Then the mixture was diluted with 25 parts of Isopar G and kneaded by a ball mill for approximately 10 hours. Five g of the toner paste so obtained was dispersed in 1 *l* of Isopar G to prepare a liquid developer of a positive polarity. A copy for use as an offset printing plate was preapred and 2,000 sheets of copies were reproduced, in a manner similar to that of Example 1. All images of the copies were clear.

For comparison, purposes, liquid developers were prepared and tested for their printing performances in a manner similar to that described above wherein various mixtures of a cyclized rubber ("Pliolite NR 50", trade name, supplied by Goodyear Co.) and polylauryl methacrylate were used instead of the cyclized rubber-lauryl methacrylate copolymer.

Test results are shown in Table IV.

Table IV

| Specimen No. | Composition (parts) Cyclized rubber | Composition (parts) Lauryl methacrylate | Dispersion stability (%) | Adhesion 5 min after development | Adhesion 30 min after development | Receptivity 10th copy | Receptivity 500th copy |
|---|---|---|---|---|---|---|---|
| Invention | | | | | | | |
| 1 | 9 | 1 | 54 | 1.2 | 1.3 | 1.5 | 1.5 |
| 2 | 6 | 4 | 53 | 1.1 | 1.3 | 1.5 | 1.5 |
| 3 | 5 | 5 | 53 | 1.1 | 1.3 | 1.5 | 1.5 |
| 4 | 4 | 6 | 52 | 1.0 | 1.3 | 1.5 | 1.5 |
| 5 | 1 | 9 | 52 | 1.0 | 1.3 | 1.5 | 1.4 |
| Control | | | | | | | |
| 6 | 9 | 1 | 80 | 1.1 | 1.2 | 1.4 | 1.4 |
| 7 | 6 | 4 | 70 | 0.9 | 1.1 | 1.0 | 1.0 |
| 8 | 5 | 5 | 65 | 0.8 | 1.0 | 0.8 | 0.8 |
| 9 | 4 | 6 | 60 | 0.4 | 0.5 | 0.6 | 0.6 |
| 10 | 1 | 9 | 58 | 0.2 | 0.3 | 0.3 | 0.3 |

EXAMPLE 4

| | |
|---|---|
| Carbon black (C.I. No. 77,265, "Seast 80" trade name, supplied by Tokai Denkyoku Co.) | 4 parts |
| Graft copolymer prepared in Reference Example 4 (40% solution in Solvesso 150) | 3 parts |
| Solvesso 150 | 20 parts |

The above mixture was kneaded by a ball mill for approximately 20 hours. Twenty g of the paste so obtained was dispersed in 1 *l* of Isopar H to prepare a liquid developer. Since the liquid developer exhibited a negative polarity, a positive image was formed on a master paper by projecting a nagative image microfilm. Using the copy as a printing plate, 1,000 sheets of copies were reproduced in a manner similar to that of Example 1. All images of the copies were claer.

The liquid developer was stable for storage. After the liquid developer had been maintained at 60° C for 1 month in a closed vessel, its performances were similar to those before the storage, and neither deposition nor cohesion was observed.

EXAMPLE 5

| | |
|---|---|
| Resin coated carbon ("Microlith Black CT", trade name, supplied by Ciba-Geigy) | 5 parts |
| Graft copolymer prepared in Reference Example 1 (40% solution in toluene) | 3 parts |
| Isopar H | 20 parts |

The above mixture was kneaded in a ball mill for 30 hours. Twenty-five g of the paste so obtained was dispersed in 1 *l* of Isopar G to prepare a liquid developer. A copy for an offset printing plate was prepared and 1,000 sheets of copies were reproduced, in a manner similar to that of Example 1. All copy images were clear. The liquid developers had good dispersion stability.

EXAMPLE 6

| | |
|---|---|
| Reaction product of Nigrosine, abietic acid and oleic acid | 30 parts |
| Graft copolymer prepared in Reference Example 3 (40% solution in a 1:1 mixture of toluene and xylene) | 30 parts |
| Solvesso 150 | 20 parts |
| Isopar H | 40 parts |

The above mixture was kneaded by a ball mill for 10 hours. Ten g of the paste so obtained was dispersed in 1 *l* of Isopar H to prepare a liquid developer of a positive polarity. Using the liquid developer, a positive image was formed on a master paper from an original image having a solid area of 20 $cm^2$ therein. Using the paper as offset printing plate, 3000 sheets of copies were reproduced. All images of the copies were clear.

After the liquid developer had been maintained at 60° C for 1 month, a copy for use as an offset printing plate was prepared by using the liquid developer and tested for its printing characteristics. No substantial differences were found between the two images, one produced by using the liquid developer before storage and the other, after storage.

EXAMPLE 7

Following a procedure similar to that of Example 6, a liquid developer was prepared wherein the copolymer prepared in Reference Example 2 was used instead of the copolymer prepared in Reference Example 1, with all other conditions remaining substantially the same. Using the liquid developer, a copy for use as an offset printing plate was prepared and tested for its printing performances.

The printing performances and dispersion stability were approximately equal to those of Example 5.

What we claim is:

1. A liquid developer for use in preparing a printing plate for an offset duplicator which comprises a dispersion of image-forming materials comprising finely divided colorant particles selected from a group consisting of dyes and pigments in a liquid carrier having an electrical resistivity of not less than $10^8$ ohm-cm and a dielectric constant of not more than 3.0, said liquid carrier being at least one hydrocarbon selected from the group consisting of n-paraffinic hydrocarbons, isoparaffinic hydrocarbons and their mixtures, characterized in that said image-forming material further comprises a graft copolymer of a cyclized rubber prepared from natural rubber onto which an ester of at least one acid selected from acrylic acid and methacrylic acid is grafted, said cyclized rubber having the recurring unit expressed by the structural formula

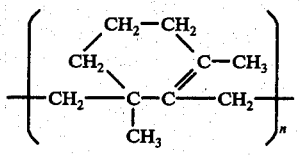

wherein

*n* is an integer such that said cyclized rubber has an average molecular weight of about 9,000 or greater and wherein said cyclized rubber has an average degree of cyclization in the range from about 20 to 80%, said ester being at least one compound selected from the group consisting of butyl acrylate, butyl methacrylate, 2-ethylhexyl acrylate, 2-ethylhexyl methacrylate, lauryl methacrylate, stearyl methacrylate, diethylaminoethyl acrylate and glycidyl methacrylate; and the amount of said graft copolymer being such that the ratio by weight of said graft copolymer to the colorant particles is within the range of 5/3 to 3/5, and the amounts of said ester and said cyclized rubber in the graft copolymer being 20 to 40% by weight and 60 to 80% by weight, respectively, based on the weight of the graft copolymer.

2. A liquid developer according to claim 1 wherein said copolymer has a viscosity of V to $Z_6$ as measured in toluene at a temperature of 25° C and a concentration of 10% by weight by using a Gardner-Holdt bubble viscometer.

3. A liquid developer according to claim 1, wherein said average degree of cyclization of said cyclized rubber is from 40 to 60%.

* * * * *

UNITED STATES PATENT OFFICE

CERTIFICATE OF CORRECTION

Patent No. 4,085,058 Dated April 18, 1978

Inventor(s) Syozo Adachi, et al.

It is certified that error appears in the above-identified patent and that said Letters Patent are hereby corrected as shown below:

Column 5, line 28, the heading Preparation of copolymers should be underlined.

Column 9, line 64, insert as a heading -- Example 3 --.

Signed and Sealed this

*Third* Day of *October 1978*

[SEAL]

*Attest:*

RUTH C. MASON
*Attesting Officer*

DONALD W. BANNER
*Commissioner of Patents and Trademarks*